US008867768B2

(12) United States Patent
Shennib et al.

(10) Patent No.: US 8,867,768 B2
(45) Date of Patent: Oct. 21, 2014

(54) EARPIECE ASSEMBLY WITH FOIL CLIP

(71) Applicant: Ihear Medical, Inc., San Leandro, CA (US)

(72) Inventors: Adnan Shennib, Oakland, CA (US); Victor Valenzuela, Hayward, CA (US); Patrick Contioso, Sunnyvale, CA (US); Greg Anderson, Fremont, CA (US)

(73) Assignee: iHear Medical, Inc., San Leandro, CA (US)

( * ) Notice: Subject to any disclaimer, the term of this patent is extended or adjusted under 35 U.S.C. 154(b) by 0 days.

(21) Appl. No.: 13/691,624

(22) Filed: Nov. 30, 2012

(65) Prior Publication Data

US 2014/0153762 A1 Jun. 5, 2014

(51) Int. Cl.
*H04R 25/00* (2006.01)

(52) U.S. Cl.
CPC ..... *H04R 25/65* (2013.01)
USPC ..... 381/328; 381/329; 381/322; 381/312

(58) Field of Classification Search
CPC ..... H04R 25/55; H04R 25/60; H04R 25/608; H04R 25/65; H04R 25/652; H04R 25/656; H04R 1/10; H04R 1/1066; H04R 1/105; H04R 1/46; H04R 2225/023; H04R 2225/025; H04R 2225/63; H04R 5/0335; H04R 2201/10; H04R 2460/15
USPC ..... 381/312, 316, 322, 328, 329, 380; 29/237
See application file for complete search history.

(56) References Cited

U.S. PATENT DOCUMENTS

| | | | |
|---|---|---|---|
| 5,327,500 | A | 7/1994 | Campbell |
| 5,553,152 | A | 9/1996 | Newton |
| 5,645,074 | A | 7/1997 | Shennib et al. |
| 5,659,621 | A | 8/1997 | Newton |
| 5,701,348 | A | 12/1997 | Shennib et al. |
| 5,785,661 | A | 7/1998 | Shennib et al. |
| 6,137,889 | A | 10/2000 | Shennib et al. |
| 6,212,283 | B1 | 4/2001 | Fletcher et al. |

(Continued)

FOREIGN PATENT DOCUMENTS

| | | | |
|---|---|---|---|
| WO | 99/07182 | | 2/1999 |
| WO | 99/07182 | A2 | 2/1999 |
| WO | WO 99/07182 | * | 2/1999 |

OTHER PUBLICATIONS

International Search Report and Written Opinion dated Nov. 3, 2010 for PCT Appl. No. US2010/048299.

(Continued)

*Primary Examiner* — Ahmad F Matar
*Assistant Examiner* — Sabrina Diaz
(74) *Attorney, Agent, or Firm* — Dorsey & Whitney LLP

(57) ABSTRACT

Examples of a removable earpiece assembly configured for coupling to a canal hearing device using a foil-thin clip are described. The earpiece assembly may be readily removed for replacement when soiled or degraded after use. The earpiece assembly may include a compliant element for contact with the ear canal in a comfortable and safe manner. The earpiece assembly may function as an acoustic seal and/or a retainer for the canal hearing device. The removable earpiece assembly may provide a highly space efficient solution which may be used with miniature canal hearing devices, including a CIC device. In some embodiments, disengagement of the earpiece assembly from the canal hearing device may be accomplished by a side peel motion.

25 Claims, 7 Drawing Sheets

(56) References Cited

U.S. PATENT DOCUMENTS

| | | | | |
|---|---|---|---|---|
| 6,359,993 | B2 | 3/2002 | Brimhall | |
| 6,367,578 | B1 | 4/2002 | Shoemaker | |
| 6,382,346 | B2 * | 5/2002 | Brimhall et al. | 181/135 |
| 6,473,513 | B1 | 10/2002 | Shennib et al. | |
| 6,546,108 | B1 | 4/2003 | Shennib et al. | |
| 6,724,902 | B1 | 4/2004 | Shennib et al. | |
| 6,937,735 | B2 | 8/2005 | DeRoo et al. | |
| 6,940,988 | B1 | 9/2005 | Shennib et al. | |
| 7,016,511 | B1 | 3/2006 | Shennib | |
| 7,113,611 | B2 | 9/2006 | Leedom et al. | |
| 7,215,789 | B2 | 5/2007 | Shennib et al. | |
| 7,260,232 | B2 | 8/2007 | Shennib | |
| 7,298,857 | B2 | 11/2007 | Shennib et al. | |
| 7,310,426 | B2 | 12/2007 | Shennib et al. | |
| 7,321,663 | B2 | 1/2008 | Olsen | |
| 7,403,629 | B1 | 7/2008 | Aceti et al. | |
| 7,424,123 | B2 | 9/2008 | Shennib et al. | |
| 7,424,124 | B2 | 9/2008 | Shennib et al. | |
| 7,580,537 | B2 | 8/2009 | Urso et al. | |
| 7,664,282 | B2 | 2/2010 | Urso et al. | |
| 8,155,361 | B2 | 4/2012 | Schindler | |
| 8,184,842 | B2 | 5/2012 | Howard et al. | |
| 8,467,556 | B2 | 6/2013 | Shennib et al. | |
| 8,571,247 | B1 | 10/2013 | Oezer | |
| 8,718,306 | B2 * | 5/2014 | Gommel et al. | 381/324 |
| 2001/0008560 | A1 | 7/2001 | Stonikas et al. | |
| 2002/0027996 | A1 | 3/2002 | Leedom et al. | |
| 2002/0085728 | A1 | 7/2002 | Shennib et al. | |
| 2005/0249370 | A1 | 11/2005 | Shennib et al. | |
| 2005/0259840 | A1 | 11/2005 | Gable et al. | |
| 2005/0283263 | A1 | 12/2005 | Eaton et al. | |
| 2006/0291683 | A1 | 12/2006 | Urso et al. | |
| 2010/0040250 | A1 | 2/2010 | Gerbert | |
| 2010/0119094 | A1 | 5/2010 | Sjursen et al. | |
| 2010/0239112 | A1 | 9/2010 | Howard et al. | |
| 2011/0058697 | A1 | 3/2011 | Shennib et al. | |
| 2011/0188689 | A1 * | 8/2011 | Beck et al. | 381/328 |
| 2011/0206225 | A1 | 8/2011 | Møller et al. | |
| 2013/0010406 | A1 * | 1/2013 | Stanley | 361/679.01 |
| 2013/0243229 | A1 | 9/2013 | Shennib et al. | |
| 2013/0294631 | A1 | 11/2013 | Shennib et al. | |
| 2014/0150234 | A1 | 6/2014 | Shennib et al. | |
| 2014/0153761 | A1 | 6/2014 | Shennib et al. | |

OTHER PUBLICATIONS

"Lyric User Guide", http://www.phonak.com/content/dam/phonak/b2b/C_M_tools/Hearing_Instruments/Lyric/documents/02-gb/Userguide_Lyric_V8_GB_FINAL_WEB.pdf, Jul. 2010.

"User Manual—2011", AMP Personal Audio Amplifiers, 2011.

* cited by examiner

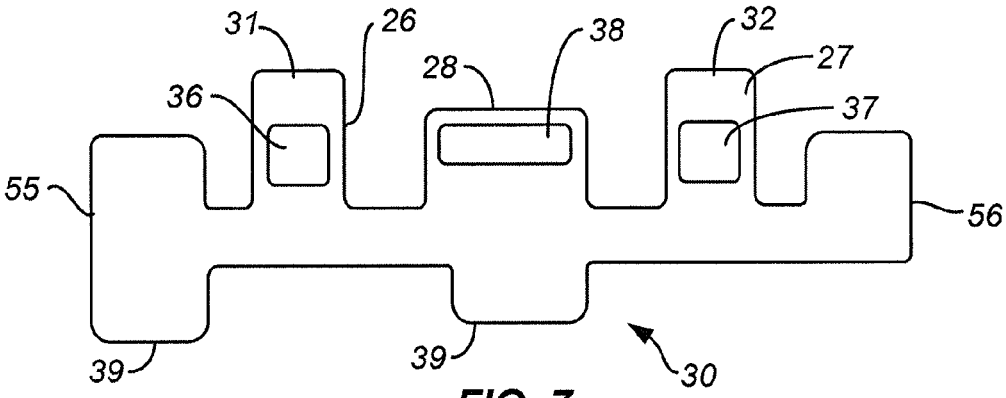
FIG. 7
FIG. 8
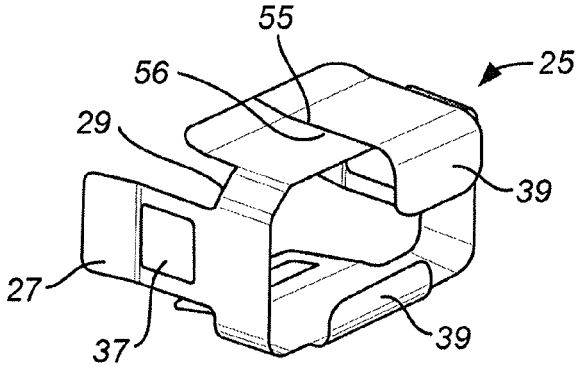
FIG. 9
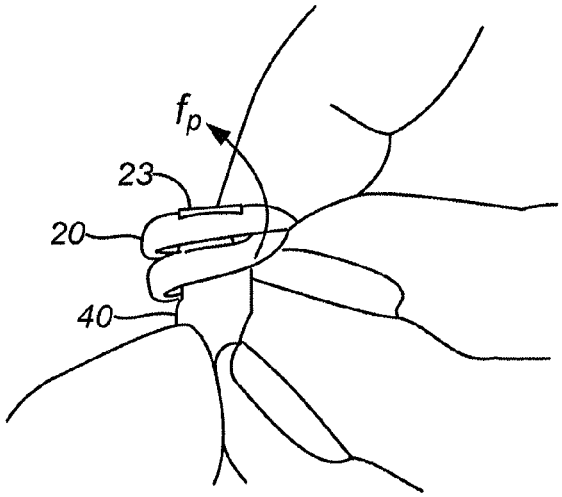

EARPIECE ASSEMBLY WITH FOIL CLIP

TECHNICAL FIELD

Examples described herein relate to hearing devices, and particularly earpiece assemblies positioned inside the ear canal. This application is related to pending patent application Ser. No. 12/878,926, titled CANAL HEARING DEVICE WITH DISPOSABLE BATTERY MODULE, and Ser. No. 13/424,242, titled BATTERY MODULE FOR PERPENDICULAR DOCKING INTO A CANAL HEARING DEVICE, which are incorporated herein by reference in their entirety for any purpose.

BACKGROUND

The ear canal 10 (FIG. 2) is generally narrow and tortuous and is approximately 26 millimeters (mm) long from the canal aperture 11 to the tympanic membrane 17 (eardrum). The lateral part is flexible and referred to as the cartilaginous canal due to the underlying cartilaginous tissue 16 beneath the skin 15. The medial part, proximal to the tympanic membrane, is rigid and referred to as the bony region due to the underlying bone tissue 13. A characteristic first bend occurs roughly at the aperture 11 of the ear canal. A second characteristic bend 18 occurs roughly at the bony-cartilaginous junction and separates the cartilaginous region and the bony region. The dimensions and contours of the ear canal vary significantly among individuals, but are generally narrow with little space for accommodating miniaturized components within. The ear canal is generally sensitive to touch and pressure, particularly in the deeper region which can readily experience discomfort, abrasion and trauma with pressure and rigid contact. Abrasion of the skin inside the ear canal due to hearing aid use is common and generally limits insertions to the lateral (outer) portions of the ear canal.

Amplified sound is preferably delivered inside the ear canal. Deep insertion of a speaker in the ear canal is advantageous for several electroacoustic reasons including reduction of the acoustic occlusion effect, improved energy efficiency, reduced distortion, reduced receiver vibrations, and improved high frequency response. Hearing devices can be fit entirely or partially inside the ear canal, including In-The-Ear (ITE), Behind-The-Ear (BTE), Receiver-In-the Canal (RIC), In-The-Canal (ITC) and Completely-In-the-Canal (CIC), as well as extended wear deep canal invisible types recently available to consumers. Hearing devices, or a receiver assembly associated with a hearing device, generally requires acoustic sealing to seal amplified sound in the residual volume of the ear canal and prevent leakage that leads to oscillations, commonly known as "feedback". An earpiece can function as an acoustic seal, or alternatively as a retention piece for a hearing device inserted in the ear canal Custom hearing devices generally rely on custom housing, or a custom ear mold, according to an impression made of an individual ear canal. Alternatively, universal designs with generic shapes are also known in the art. They rely on generic-shape rigid housing or a compliant earpiece functioning as a seal and/or a retainer, eliminating the need for custom fabrication. For example, the hearing aid industry offers an assortment of "dome" type compliant earpieces that connect with a speaker assembly for RIC devices. These earpieces are replaceable when soiled or degraded after use inside the ear canal. Due to the space constraints inside the ear canal, securing a removable earpiece assembly to the hearing device presents a challenge to hearing aid designers in terms of space efficiency, comfort, ease of replacement, security of attachment and cost. One major consideration is minimizing rigid structures associated with an earpiece while maximizing the compliant part to fit inside the ear canal without discomfort or trauma. For this reason among others, replaceable earpiece assemblies are generally limited to larger types of hearing devices such as BTE and RIC, rather than canal hearing devices.

SUMMARY

The present disclosure describes examples of earpiece assemblies, seal assemblies and methods for use of an earpiece assembly with canal hearing devices. An earpiece for a canal hearing device according to some examples herein may include a clip element formed from metal foil or other rigid materials having a thickness of 0.2 mm or less that is configured to be attached to a rigid medial end of a canal hearing device encapsulating a speaker assembly therewithin. The clip element is generally deformable when the earpiece is detached from the canal hearing device.

The clip element may include one or more cut-outs for latching with one or more protruding features, for example bosses, on the canal hearing device to provide secure attachment of the earpiece assembly to the canal hearing device when joined thereto and inserted into the ear canal.

The earpiece also includes a relatively compliant element at least partially concentrically positioned over the clip element. The compliant element may provide acoustic attenuation in the audiometric frequency range of about 1,000 to about 4,000 Hz.

The earpiece assembly may also include a filter configured to be disposed across a receiver port of the receiver assembly within the canal hearing device.

BRIEF DESCRIPTION OF THE DRAWINGS

The above and still further objectives, features, aspects and attendant advantages of the present invention will become apparent from the following detailed description of certain preferred and alternate embodiments and method of manufacture and use thereof constituting the best mode presently contemplated of practicing the invention, when taken in conjunction with the accompanying drawings, in which:

FIG. 7 shows a foil coupon prior to forming the coupon into a clip element.

FIG. 8 is an isometric view of a clip element formed from the coupon in FIG. 7.

FIG. 9 is an illustration of the earpiece assembly being disengaged from the canal hearing device according to an example of the present disclosure.

DETAILED DESCRIPTION

Figure 1:
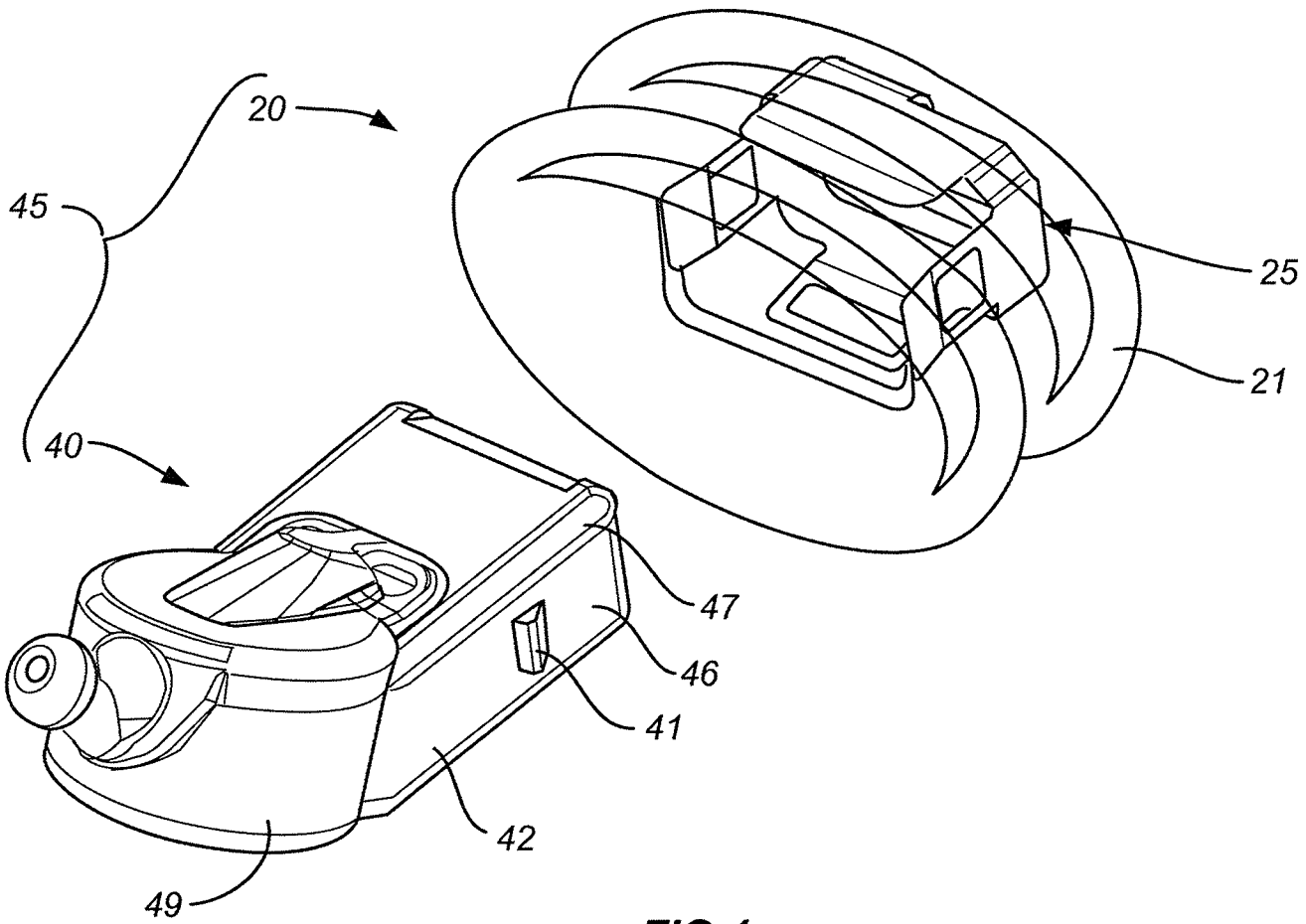
FIG. 1 is an isometric view of an earpiece assembly and a canal hearing device according to examples of the present disclosure.

Certain details are set forth below to provide a sufficient understanding of embodiments of the invention. However, it will be appreciated by one skilled in the art that some embodiments may not include all details described. In some instances, well-known structures, hearing aid components, circuits, and controls, have not been shown in order to avoid unnecessarily obscuring the described embodiments of the invention.

Removable earpiece assemblies and methods for using and attaching the same to canal hearing devices are described herein. An earpiece assembly according to the present disclosure may include a compliant element and a clip element. A seal assembly according to the present disclosure is an earpiece assembly with additional acoustic sealing features. The compliant element may be made of a soft polymeric material, such as a biocomaptible elastomer, and may be configured for a conforming fit within the ear canal of a user. The compliant element may be configured to fit circumferentially or at least partially coaxially around a portion of the canal hearing device (e.g., the medial end of the canal hearing device). The compliant element may be configured to provide an acoustic seal for the canal hearing device when worn.

A canal hearing device for the purpose of this application generally includes any hearing device that fits partially or entirely inside the ear canal, including but not limited to those disclosed in pending patent application Ser. No. 12/878,926, titled CANAL HEARING DEVICE WITH DISPOSABLE BATTERY MODULE, and Ser. No. 13/424,242, which applications are incorporated herein by reference in their entirety, as well a receiver assembly of a RIC hearing device.

The compliant element may be configured to be removably mounted to a canal hearing aid device using the clip element. The clip element may be made from a material which is stiffer than the material from which the compliant element is made, for example to provide an effective mechanism for mounting the earpiece assembly to the canal hearing device, as will be further described. In some embodiments, the clip element may be formed from a thin metal foil. In other embodiments, the clip element may be made of a thin sheet of material other than metal. The clip element may be removably or fixedly attached to the compliant element. The clip element may be configured to engage with the canal hearing device for securing the earpiece assembly to the canal hearing device. In some examples, the clip element may have a shape corresponding to the shape of the canal hearing device at the attachment portion of the canal hearing device (typically the medial end of the canal hearing device). The clip element may include features adapted for cooperating fit with the attachment end of the canal hearing device. For example, the clip element may include one or more tabs with one or more openings therethrough, which may be adapted for a snap fit with the attachment end of the canal hearing device. In other examples, the clip element may include one or more protrusions configured to insert into one or more corresponding holes formed in the attachment end of the canal hearing device. Other attachment mechanisms or features may be used, and examples of some attachment mechanisms according to the present disclosure will be further described below.

Examples of earpiece assemblies, such as the removable earpiece assembly 20 configured to be attached to a canal hearing device 40, are described in further detail below with reference to FIGS. 1-13. The earpiece assembly 20 of the present example includes a compliant element 21 and a clip element 25, which may be foil thin and made of a relatively rigid material. The earpiece assembly 20 may be configured to securely and removably attach to the canal hearing device 40, forming a canal hearing assembly 45 for insertion inside the ear canal 10 (FIG. 2). In some embodiments, the earpiece assembly 20 may be disposable for readily replacing when soiled or degraded after use within the ear canal 10.

The compliant element 21 of the earpiece assembly may be coupled to the canal hearing device using a clip element, as will be further described. The compliant element 21 may be configured to cover portions of the canal hearing device 40, for example a medial end 46 of the canal hearing device 40, which may be rigid. In other examples, the compliant element 21 may be configured for placement circumferentially around a intermediate portion of the canal hearing device 40. In this manner, the compliant element may provide for a comfortable non-injurious wear of the canal hearing device 40 in situ.

The compliant element 21 may be configured to substantially enclose or concentrically cover the clip element 25, which may be relatively rigid, and thereby facilitate a conforming comfortable non-injurious wear of the canal hearing assembly 45 within the ear canal. The earpiece assembly 20 may function as an acoustic seal for preventing feedback, alternatively, or in addition to, as a retainer for securing the hearing device inside the ear canal 10. The earpiece assembly 20 when including sealing features, may accordingly be referred to as a seal assembly. The removable earpiece assembly 20 may be highly compliant and space efficient and may fit in a variety of ear canal sizes, including small and tortuous ones, which may be particularly advantageous for use with CIC devices. The clip element 25 in some embodiments is formed of paper-thin metal foil and may consume negligible space (volume) while offering sufficient structural strength for secure attachment of the earpiece assembly 20 to the canal hearing device 40.

The clip element 25 may be configured to be removably attached to the canal hearing device 40. For example, the clip element 25 may include attachment mechanisms configured to provide secure engagement between the clip element 25 and the canal hearing device 40. In some examples, the clip element 25 may include locking tabs (26, 27 and 28 in FIG. 4), with cut-outs (36, 37 and 38) respectively, which may be configured to mate with protruding bosses (e.g., right boss 41 shown in FIGS. 4 and 5, and bottom boss 43 shown in FIG. 6) on the housing 42 of the hearing device 40. One or more of the bosses (41 and 43) may be configured to have one or more angled faces for allowing the bosses to interlock with the cut-outs (36, 37 and 38) while providing releasable engagement with the locking tabs (26, 27 and 28). The locking tabs may be tapered with flanges (31 and 32), for example, also referred to herein as lead-in flanges, for sliding over and snapping into engagement with the medial end 46 of the canal hearing device. It will be understood by one skilled in the art that other known attachment mechanisms may be used for secure attachment of the earpiece assembly 20 to the canal hearing device 40.

In some embodiments, the holding force of the earpiece assembly 20 to the hearing device 40 may be sufficient to ensure secure attachment between the earpiece assembly and hearing device. For example, the holding force may be about 2 lbs or greater so as to prevent inadvertent detachment of the earpiece assembly 20, for example while the canal hearing assembly 45 is being removed from the ear canal. A holding force ($f_H$) of 2 lbs may exceed typical forces required for removal of the canal hearing device 40 from the ear canal 10 and may thus provide sufficiently secure attachment of the earpiece assembly 20 to the canal hearing device 40. An advantage of a clip element including lead-in flanges (31 and 32) may be to allow the earpiece assembly to be attached to the canal hearing device using minimal clip-on or attachment force ($f_A$), which in some examples may be less than 0.5 lbs. This level of clip-on force may represent minimal effort by the user to axially engage the earpiece assembly 20 to the canal hearing device 40.

Figure 5:
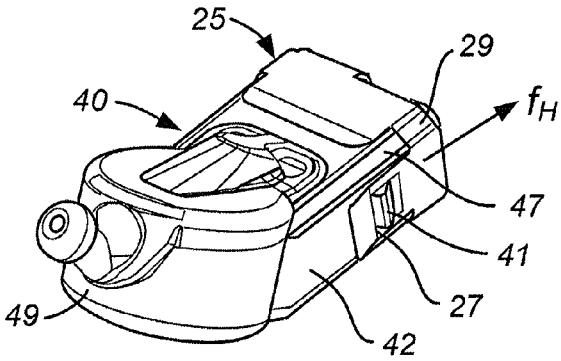
FIG. 5 is a side isometric view of the clip element and canal hearing device of FIG. 4, the clip element shown in engagement with the medial end of a canal hearing device. Similarly, the compliant element of the earpiece assembly is not shown for clarity.
Figure 6:
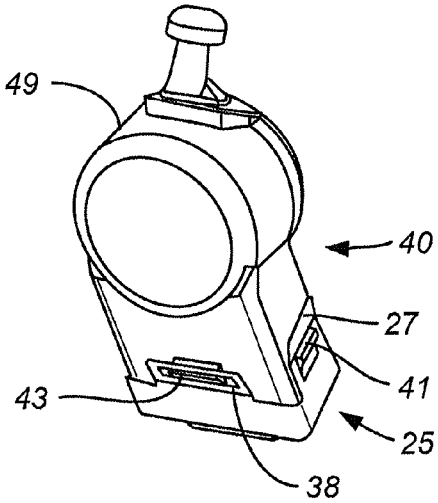
FIG. 6 is a bottom isometric view of the clip element and canal hearing device of FIG. 5, showing examples of primary and secondary locking features. The compliant element of the earpiece assembly is not shown for clarity.
Figure 10:
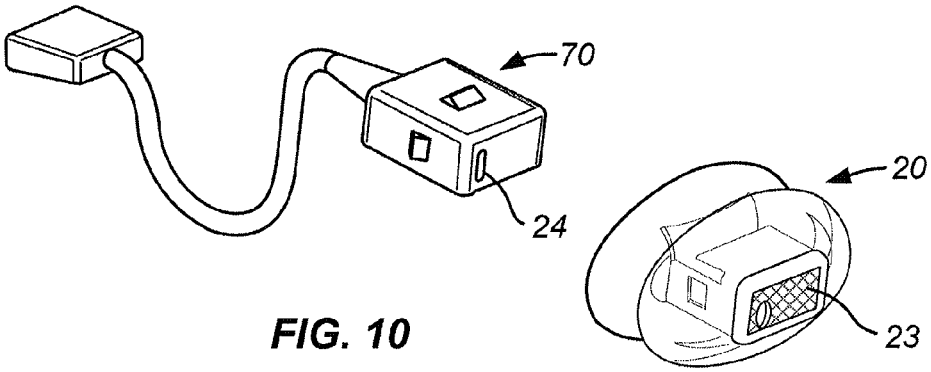
FIG. 10 is an isometric view of an earpiece assembly according to the present disclosure prior to engaging the earpiece assembly with a speaker assembly of a Receiver In the Canal (RIC) device.

FIG. 9 shows an illustration of the earpiece assembly being disengaged from the canal hearing device according to an example of the present disclosure. In some embodiments, the earpiece assembly may be disengaged by peeling the earpiece assembly from the canal hearing device. The earpiece may be peeled off the canal hearing device using an axial and rotating motion or a generally axial motion. For example, disengagement of the earpiece assembly 20 from the canal hearing device 40 may be accomplished by holding the hearing device 40 from its lateral end 49 and performing a rotational side-peel motion on the earpiece assembly with peel force as shown with arrow $f_P$ in FIG. 9. Such motion may allow the side tab 27 on the clip element 25 to deform and disengage from the side boss 41 on the medial end 46 of the canal hearing device 40. Alternatively, the clip element 25 and canal hearing device 40 may be configured to disengage by axial unsnap force in the direction of holding force ($f_H$) as shown in FIG. 5.

Clip elements according to the present disclosure may be formed from a variety of materials, including metals, polymers, or others. In some examples, the clip element 25 of the earpiece assembly 20 may be formed from thin metal foil not exceeding about 0.2 mm in thickness. In some embodiments, the thin metal foil may have a thickness in the range of about 0.05 mm to about 0.08 mm, taking up negligible volume with respect to the earpiece assembly 20, as well as the ear canal 10, for example as shown in FIG. 3B. In some embodiments, the clip element 25 may be made of steel foil. However, other metallic or non-metallic materials may be used to achieve sufficient structural stability for secure attachment, while minimizing volume and cross sectional thickness of the clip element 25. FIG. 3B illustrates the space efficiency which may be achieved by the examples herein.

Figure 3A:
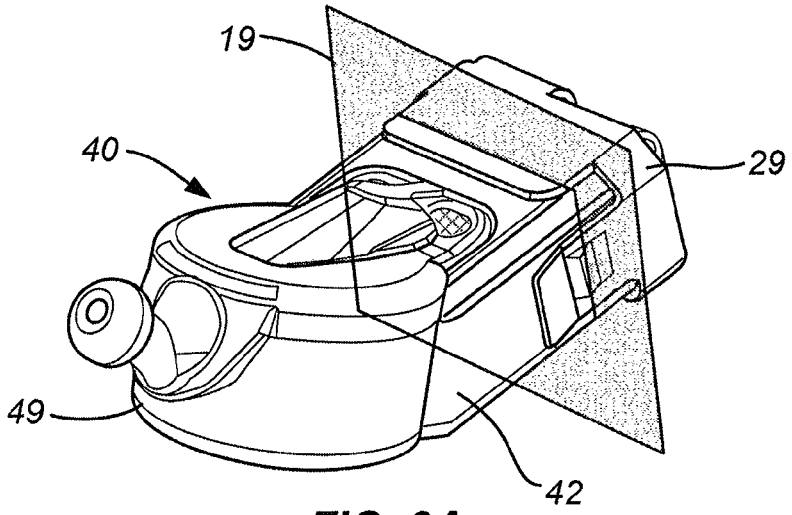
FIG. 3A is an isometric view of a canal hearing device in engagement with a clip element according to the present disclosure
Figure 3B:
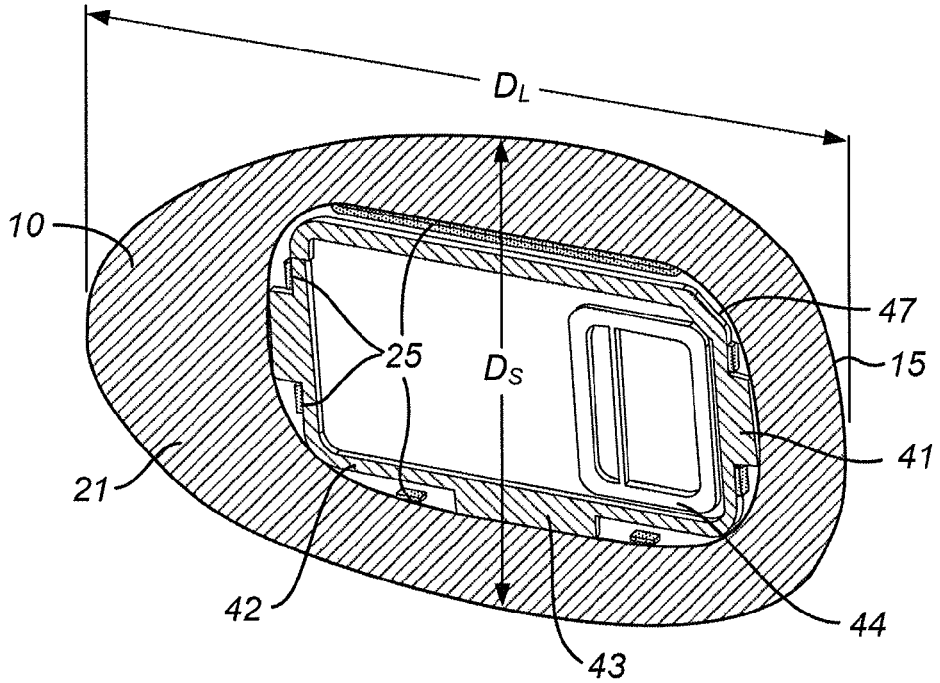
FIG. 3B is a cross sectional view of the earpiece assembly and medial end of the canal hearing device of FIG. 2 taken along the cross section plane depicted in FIG. 3A.

FIG. 3B is a cross sectional view of the example in FIG. 3A at the cross sectional plane 19. Relative dimensions of the clip element 25 with respect to the compliant element 21 and canal hearing device 40, including certain components of the canal hearing device, are shown. As shown in FIG. 3B, a high ratio of compliant to rigid material may be achieved using the examples herein, thus providing comfortable contact with the walls 15 of the ear canal, particularly in the deeper portion such as the bony-cartilaginous region which is generally highly sensitive to touch and pressure. Deep ear canal impressions were taken from 12 subjects and measurements of ear canal diameters, long diameter $D_L$, and short diameter Ds, were measured averaging 9.5 and 6.3 mm, respectively. The dimensions of the housing of a prototype canal hearing device 40 measured 6.3 mm×4.3 mm at the cross section, accommodating a receiver assembly 44 therewithin. The compliant element 21 spans the distance between the device housing 42 and the skin 15 of the ear canal 10 as shown in FIG. 3B. It will be apparent with these dimensions in mind, that thickness of the clip element 25, for example in the range of 0.05 mm to 0.08 mm, may represent an insignificant percentage by volume of the earpiece assembly 20 and may take up negligible space relative to the ear canal dimensions. A 0.08 mm in thickness for the clip element 25 may represent approximately 1.2% of the average short diameter dimension in the ear canal.

Figure 4:
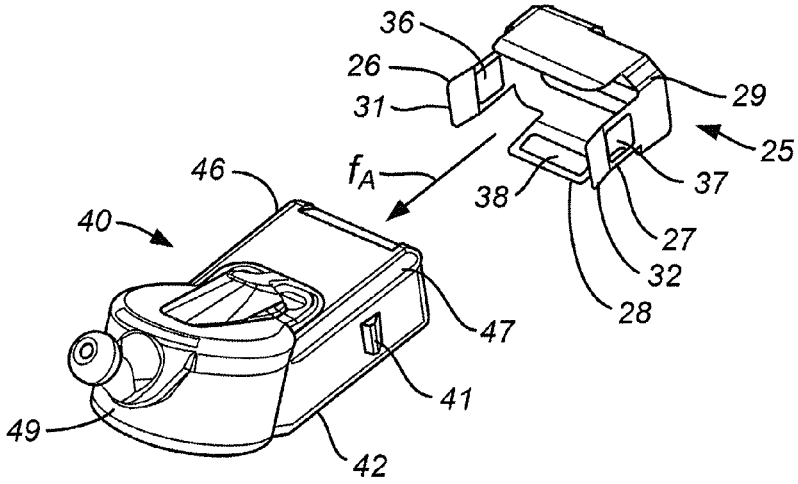
FIG. 4 is an exploded side isometric view of a clip element prior to engaging axially with the medial end of a canal hearing device according to examples of the present disclosure. For clarity and to avoid obfuscating features of the clip element, the compliant element of the earpiece assembly is not shown in this figure.

Although made of relatively rigid material, the clip element 25 may be generally flexible and deformable when pressed by hand by virtue of its thinness. However, once the earpiece assembly 20 is formed and attached to the hearing device 40 forming the canal hearing device assembly 45, the clip element 25 may generally assume the inward rigidity of the underlying structure, namely the housing 42 of the canal hearing device. Using such paper-thin clip implementation for an attachment mechanism between the compliant element and the canal hearing device not only provides secure attachment but also consumes virtually no space and minimizes injury to the ear canal by concealing virtually all of the rigid material of the clip element and presenting mostly the compliant element 21 to the ear canal. As described, the compliant element 21 may be circumferentially disposed around the canal hearing device thereby further minimizing contact or risk of contact with any rigid materials within the ear canal. The clip element 25 may be keyed for proper directional engagement with the rigid housing 42 of the canal hearing device 40. For example, a chamfer 29 may be used for keyed engagement with a corner 47 feature on the housing 42 of the canal hearing device 40 as shown in FIGS. 4 & 5. In some embodiments, the earpiece assembly 20 may further include a filter 23 (FIG. 10) for protecting the receiver assembly 44, and particularly the receiver port 24 of the canal hearing device from contaminants present in the ear canal. The filter 23 may be generally disposed across the receiver port 24 to prevent contaminants from the ear canal from entering the receiver port 24.

In certain embodiments, the canal hearing assembly 45 is worn substantially or entirely inside the ear canal 10. The canal hearing device 40 may include a receiver assembly 44, which may be located, at least partially, in the medial end 46 of the canal hearing device 40. In other embodiments, the canal hearing device 40 may be a separate receiver assembly 70 (FIG. 10) configured to fit inside the ear canal 10, for example as in RIC devices. The earpiece assembly 20 of the present disclosure may be formed by bonding the compliant element 21 to the clip element 25. For example, in instances in which the compliant element 21 is positioned generally concentrically about the clip element, the clip element may be bonded at some or all concentric contact surfaces. An adhesive (not shown) may be used for the bonding. Other techniques for attaching the clip element 25 to the compliant element 21 may be used. For example, insert molding (also referred to as over-molding) may be used during the fabrication process to simultaneously mold and bond the compliant element 21 to the clip element 25. The clip element 25 surface may be treated (not shown) to enhance the bonding of the compliant element 21 to the clip element 25. The clip element 25 may use other techniques or features to enhance the bond between the clip element and the compliant element. For example through holes, slits, or roughened surfaces may be used to allow polymer material of the compliant element to flow through and/or generally interlock better with portions of the clip element during the insert molding process.

Further examples of clip elements and forming clip elements according to examples of the present disclosure will be described further with reference to FIGS. 7-12. FIG. 7 shows an example of a coupon which may be formed from a thin sheet of material (e.g. a metal foil) and used to obtain a clip element according to the present disclosure. The clip element 25 may be formed from the coupon 30 initially formed from a flat metal foil, as shown in FIG. 7. The coupon may be shaped to incorporate the features of the final clip element 30, for example tabs (26, 27 and 28), cut outs (36, 37 and 38), stop tabs 39 and other features. The coupon may be formed using a variety of conventional technique including die cutting, stamping, or others. In some examples, the pattern of the coupon may be etched or milled by a chemical, laser or a stamp process. The coupon 30 may subsequently be formed into the shape of the clip element 25, as shown in FIG. 8. For example, the clip element may have a generally rectangular or box shape defined by sides of the clip element 25 and the stop tabs 39 located at the end opposite the insertion end of the clip element. In other examples, the clip element may take on a cylinder shape (not shown) and may be configured to attach to a canal hearing device having a complementary cylinder shape. The edges (55 and 56) of the clip element 25 may be joined by welding or adhesive bonding. Techniques for welding of the formed joint may include laser welding, Tungsten Inert Gas (TIG) welding, and the like. The joining or bonding of the formed joint, for example at the junction of edges 55 and 56, may provide for sufficient structural integrity of the clip element 25 regardless of the generally flimsy thin foil material from which the clip element 25 may originally have been formed.

Figure 2:
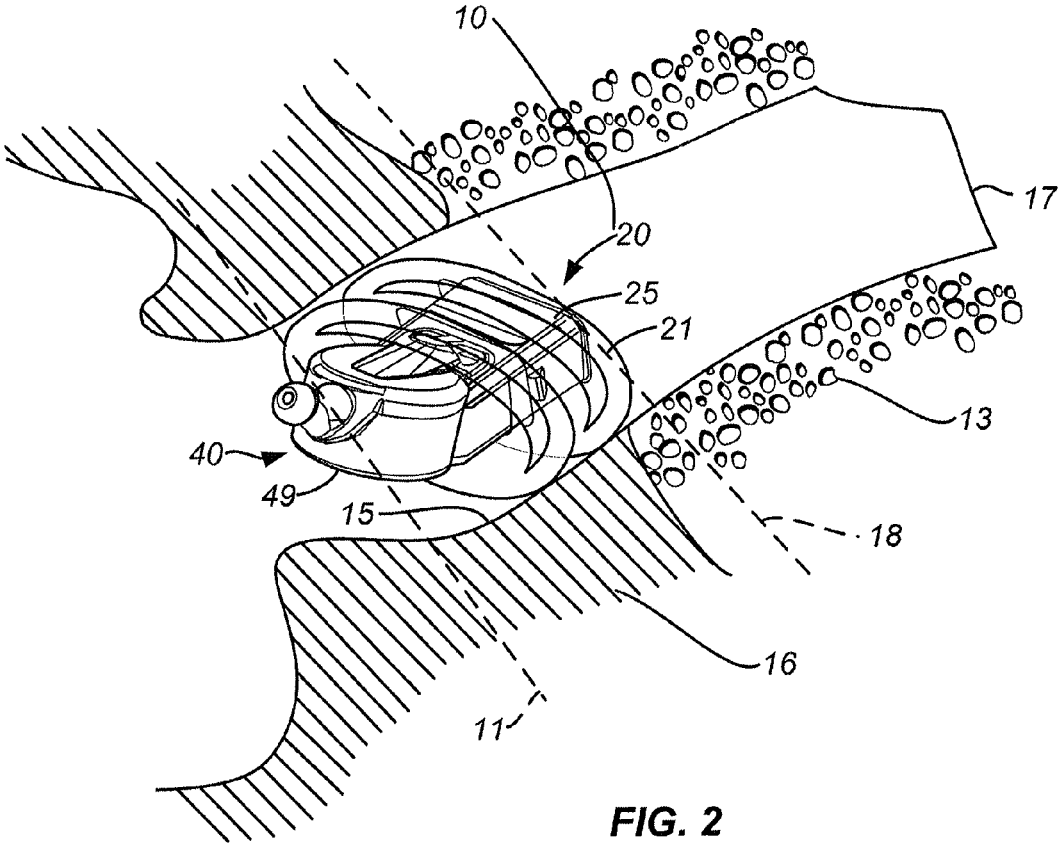
FIG. 2 is a view of a canal hearing assembly including the earpiece assembly and canal hearing device of FIG. 1 depicted inside the ear canal.
Figure 13:
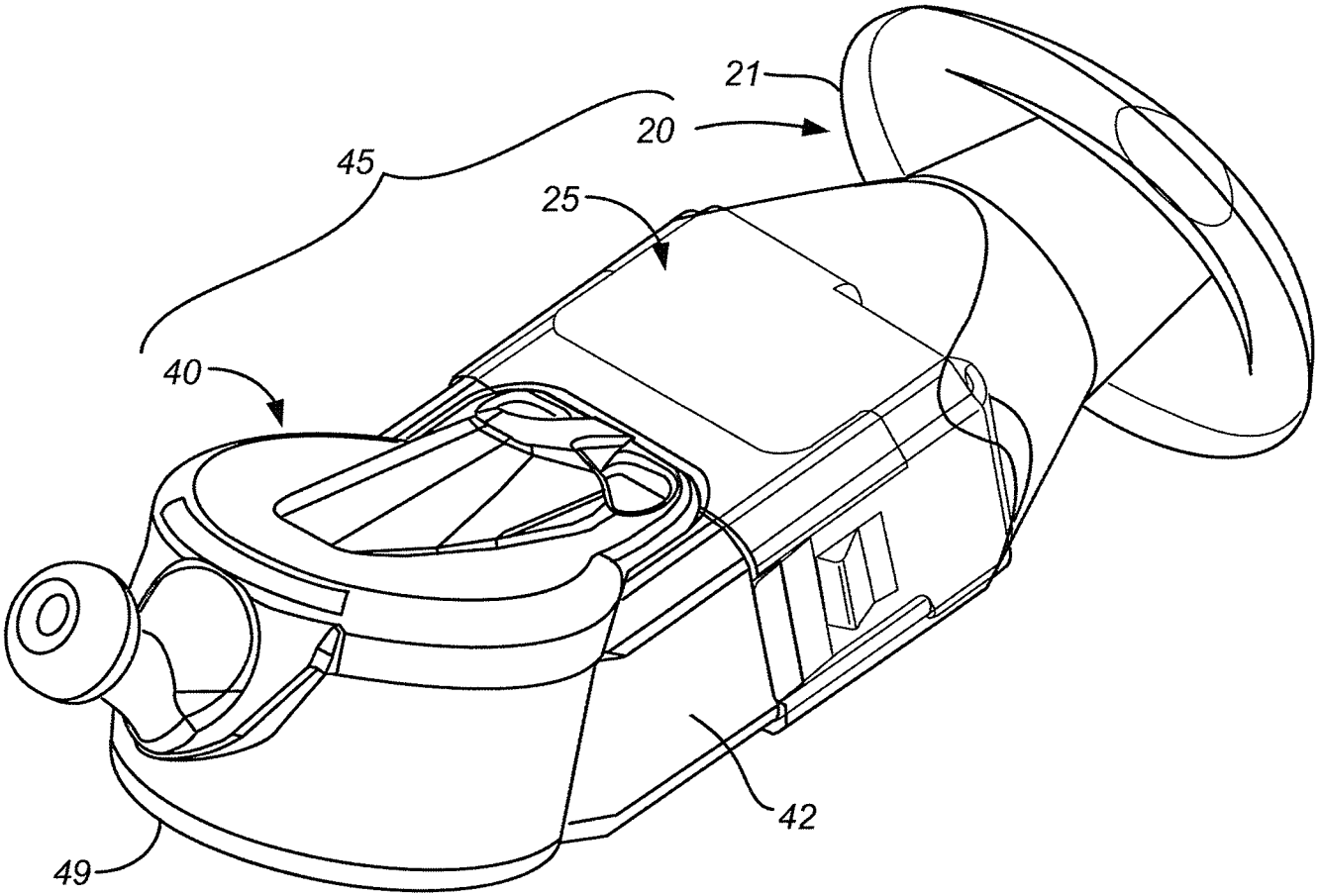
FIG. 13 is an isometric view of an earpiece assembly with compliant element according to another example of the present disclosure.

The compliant element 21 may be positioned concentrically over the clip element 25 as shown in FIGS. 1 and 2 to cover the clip element and protect the ear canal 10 from contacting the clip element and/or canal hearing device, which may be made from rigid materials. The compliant element 21 may extend medially, for example as shown in FIG. 13, to provide contact in closer proximity to the tympanic membrane. The compliant element 21 may provide comfortable non-injurious contact with the skin 15 of the ear canal 10. In embodiments in which the earpiece assembly is configured to provide an acoustic sealing function, the compliant element 21 may be configured for sealing contact with the skin 15. In such examples, the sealing assembly (e.g., earpiece assembly 20) may provide acoustic attenuation across the audiometric frequency range, particularly between 1,000 to 4,000 Hz. The compliant element 21 may be made from Silicone® or other biocompatible elastomeric material such as polyurethane and neoprene. The elastomeric material may be of thermoset or thermoplastic types, however other polymers currently known or later developed, may be used instead. In other examples, the compliant element 21 may function as a retainer for holding the hearing device 40 comfortably inside the ear canal 10.

The earpiece assembly 20 may be implemented as a disposable component for periodic replacement thereof, for example weekly, biweekly, or monthly. The replacement period may also depend on individual use and ear canal environment, which is known to vary across individuals. An advantage of having a disposable earpiece assembly may be to provide user-friendly maintenance for the canal hearing device. In some examples, the earpiece assembly 20 may also be removed for washing, or otherwise cleaning for reuse.

Figure 11:
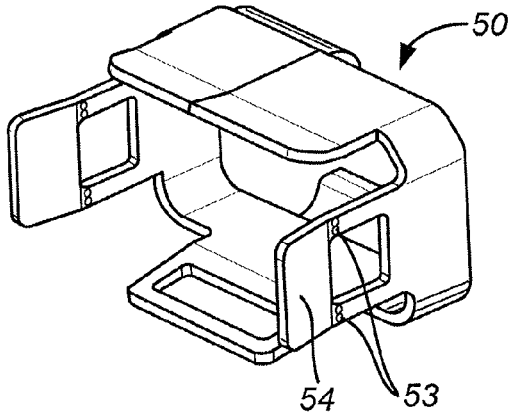
FIG. 11 is an isometric view of an alternate embedment of a clip element according to the present disclosure
Figure 12:
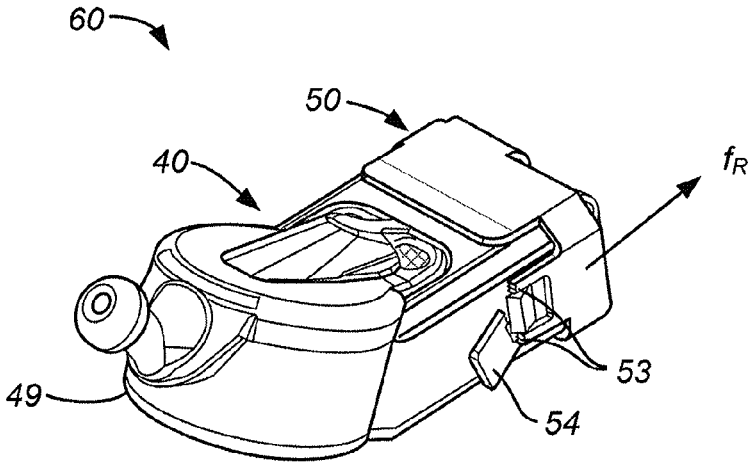
FIG. 12 is an isometric view of the clip element of FIG. 11 shown in engagement with a canal hearing device.

An alternate embodiment of the earpiece assembly 20 is shown in FIGS. 11 and 12, which may include a clip element 50. The clip element 50 may be made of thin material other than metal, which may have a thickness of about 0.2 mm or less. The clip element 50 may be made from a thermoplastic material, such as Polyether Ether Ketone (PEEK), which may provide excellent mechanical and chemical resistance properties for biocompatible use inside the ear canal. Analogous to the clip element 25 described herein, the clip element 50 may include some or all of the features and may be configured to provide some or all of the functionality of clip element 25. In a similar manner to clip element 25, the clip element 50 may be formed from a thin and generally flimsy sheet of material (e.g. when the sheet is in its original flat state). The clip element 50 may be deformable to a certain degree in the molded state, for example to allow certain amount of deflections and/or deformations of the tabs for attachment of the clip element 50 to the hearing device. Regardless of the thin raw material from which the clip may be formed, the clip element 50 may nevertheless provides sufficient structural integrity for secure attachment to a canal hearing device 40 forming the canal hearing assembly 60 (FIG. 12, compliant element not shown for clarity).

In certain embodiments according to the present disclosure, the clip element 50 may further include one or more perforation sections 53 (FIG. 11), which may be adapted to tear during disengagement of the earpiece assembly 20 from the canal hearing device 60. In these examples, the earpiece assembly may be configured for single-use disposable wear. Tearing of the perforation sections 53 may occur when an axial removal force ($f_R$) is applied causing a break at the perforation section 53 and partial or full separation of the flange section 54 as shown in FIG. 12. The earpiece assembly may also be removable by the use of a miniature tool (not shown).

Although examples of the invention have been described herein, it will be recognized by those skilled in the art to which the invention pertains from a consideration of the foregoing description of presently preferred and alternate embodiments and methods of fabrication and use thereof, and that variations and modifications of this exemplary embodiment and method may be made without departing from the true spirit and scope of the invention. Thus, the above-described embodiments of the invention should not be viewed as exhaustive or as limiting the invention to the precise configurations or techniques disclosed. Rather, it is intended that the invention shall be limited only by the appended claims and the rules and principles of applicable law.

What is claimed is:

1. A seal assembly configured for removable attachment to a canal hearing device and adapted to provide acoustic sealing in the ear canal, the seal assembly comprising:

a clip element formed of a rigid material having a thickness of 0.2 mm or less, wherein the clip element is configured to be attached to a rigid medial end of the canal hearing device encapsulating a speaker assembly therewithin, wherein the clip element comprises one or more locking tabs axially oriented, the locking tabs being deformable when the seal assembly is being detached from the canal hearing device by application of a separating axial force; and a relatively compliant seal element, at least partially concentrically positioned over the clip element, wherein the compliant seal element is bonded to the clip element and configured to provide acoustic attenuation in the audiometric frequency range of 1,000 to 4,000 Hz.

2. The seal assembly of claim 1, wherein the one or more locking tabs comprises one or more cut-outs configured for cooperating fit with protruding features of the canal hearing device and latching thereto.

3. The seal assembly of claim 1, wherein the clip element is made of any of metal or plastic.

4. The seal assembly of claim 1, wherein the one or more locking tabs are tapered.

5. The seal assembly of claim 1, wherein the compliant seal element is made of a biocompatible elastomer.

6. The seal assembly of claim 1, wherein the clip element is configured for keyed engagement with the canal hearing device.

7. The seal assembly of claim 1, wherein the clip element further comprises one or more segments configured to tear during removal of the seal assembly from the canal hearing device.

8. The seal assembly of claim 1, wherein the seal assembly is configured to be attached to the canal hearing device using a snap mechanism.

9. The seal assembly of claim 1, wherein the seal assembly is configured to be disengaged from the canal hearing device using a tool.

10. The seal assembly of claim 1, wherein the one or more locking tabs are configured to engage with one or more protruding features on a medial end of the canal hearing device, wherein the one or more protruding features comprise angled surfaces on medial and lateral sides.

11. The seal assembly of claim 1, wherein the clip element is configured to disengage from the canal hearing device when a separating axial force of 2 lbs or more is applied between the canal hearing device and the clip element.

12. The seal assembly of claim 1, wherein the clip element is configured to engage with the canal hearing device when a clip-on force of 0.5 lbs or less is applied between the canal hearing device and the clip element.

13. The seal assembly of claim 1, wherein the seal assembly is configured to be removed from the canal hearing device by a side-peel motion.

14. The seal assembly of claim 1, wherein the seal assembly is configured to be removed from the canal hearing device by an axial unsnap motion.

15. An earpiece assembly for insertion into the ear canal, wherein the earpiece assembly is configured to be removably attached to a canal hearing device to securely retain the canal hearing device inside the ear canal, the earpiece assembly comprising:

a clip element formed of a rigid material not exceeding 0.2 mm in thickness, wherein the clip element is configured to securely attach to the canal hearing device encapsulating a receiver assembly concentrically therewithin, wherein the clip element further comprises one or more locking tabs axially oriented, the locking tabs being deformable when the earpiece assembly is being detached from the canal hearing device by application of a separating axial force; and a compliant element, at least partially concentrically positioned about the clip element, wherein the compliant element is bonded to the clip element.

16. The earpiece of claim 15, wherein the one or more locking tabs comprises one or more cut-outs configured for engaging with protruding features of the canal hearing device, wherein the protruding features comprise angled surfaces on media and lateral sides thereof.

17. The earpiece assembly of claim 15, wherein the compliant element is made of a biocompatible elastomer.

18. The earpiece assembly of claim 15, wherein the earpiece assembly is attached to the canal hearing device using a snap mechanism.

19. An earpiece assembly for removable attachment to a canal hearing device, the earpiece assembly comprising:

a clip element made of a rigid material having a thickness of 0.2 mm or less, wherein the clip element is configured for attaching the earpiece assembly to a medial end of the canal hearing device including a receiver assembly therewithin, wherein the clip element comprises one or more locking tabs axially oriented, the locking tabs being deformable when the earpiece assembly is being detached from the canal hearing device by application of a separating axial force; and a filter configured to be disposed across a receiver port of the receiver assembly within the canal hearing device; and a compliant element, bonded to the clip element and positioned circumferentially around the clip element, wherein the clip element includes one or more cut-outs for latching with one or more bosses on the canal hearing device to provide secure attachment of the earpiece assembly to the canal hearing device when joined thereto and inserted into the ear canal.

20. A method of use of an earpiece assembly removably coupled to a canal hearing device, the method comprising:

coupling the canal hearing device to the earpiece assembly configured for cooperating fit with the canal hearing device by applying an axial force therebetween, wherein the earpiece assembly includes a clip element formed of a rigid material having a thickness of 0.2 mm or less, and a compliant element bonded to the clip element, the compliant element at least partially concentrically positioned over the clip element of the earpiece assembly, wherein the clip element comprises one or more locking tabs axially oriented, the one or more locking tabs comprising one or more cut-outs configured for cooperating fit with one or more protruding features of the canal hearing device and latching thereto, wherein the one or more locking tabs are configured to engage with the one or more protruding features on a medial end of the canal hearing device wherein the one or more protruding features comprise angled surfaces on medial and lateral sides thereof; and inserting the canal hearing device and the earpiece assembly attached thereto into the ear canal for delivering sound within the ear canal.

21. The method of claim 20, further comprising removing the earpiece assembly from the canal hearing device.

22. The method of claim 21, wherein removing the earpiece assembly from the canal hearing device includes using a side-peel motion.

23. The method of claim 21, wherein removing the earpiece assembly from the canal hearing device includes applying an axial separating force between the canal hearing device and the clip element.

24. The method of claim 20, further comprising acoustically sealing inside the ear canal when worn therein using the compliant element.

25. A method for removing an earpiece assembly from a canal hearing device, the method comprising:

wearing the canal hearing device attached to the earpiece assembly, wherein the earpiece assembly comprises a clip element formed of rigid material having thickness of 0.2 mm or less, the clip element comprising one or more looking tabs axially oriented, the locking tabs being deformable when the earpiece assembly is being detached from the canal hearing device, and wherein the earpiece assembly further comprises a compliant element bonded to the clip element, the complaint element at least partially concentrically positioned over the clip element of the earpiece assembly; and detaching the earpiece assembly from the canal hearing device by applying a separating axial force.

* * * * *